US005440331A

United States Patent [19]

Grange

[11] Patent Number: 5,440,331

[45] Date of Patent: Aug. 8, 1995

[54] PRINTHEAD SERVICING APPARATUS

[75] Inventor: Jeffrey J. Grange, Brush Prairie, Wash.

[73] Assignee: Hewlett-Packard Company, Palo Alto, Calif.

[21] Appl. No.: 994,384

[22] Filed: Dec. 21, 1992

[51] Int. Cl.[6] ..... B41J 2/165

[52] U.S. Cl. ..... 347/32; 347/33

[58] Field of Search ..... 346/140 R; 347/29, 32, 347/33

[56] References Cited

U.S. PATENT DOCUMENTS

| | | | |
|---|---|---|---|
| 4,853,717 | 8/1989 | Harmon et al. | 346/140 R |
| 4,872,026 | 10/1989 | Rasmussen et al. | 346/140 R |
| 5,027,134 | 6/1991 | Harmon et al. | 346/140 R |
| 5,103,244 | 4/1992 | Gast et al. | 346/1.1 |
| 5,115,250 | 5/1992 | Harmon et al. | 346/1.1 |
| 5,155,497 | 10/1992 | Martin et al. | 346/1.1 |

FOREIGN PATENT DOCUMENTS

055203A1 7/1993 European Pat. Off. .

*Primary Examiner*—Fuller, Benjamin R.
*Assistant Examiner*—Valerie Ann Lund

[57] ABSTRACT

An apparatus for use servicing a printer's printhead is provided which includes a sled cam-coupled with a base so as to accommodate selected movement of the sled between a free elevation and a servicing elevation via controlled relative movement of a printer carriage. The sled and base are coupled via camming structure which is configured to yieldably oppose movement of the sled from the servicing elevation toward the free elevation. Mounted to the sled is a servicing member such as a wiper which is gradually moved into operative association with the printer's printhead upon corresponding movement of the sled into the servicing elevation.

20 Claims, 3 Drawing Sheets

PRINTHEAD SERVICING APPARATUS

TECHNICAL FIELD

The present invention relates generally of the servicing of printer printheads, and more particularly, to an improved apparatus for use in the servicing of a printer's printhead upon selected printer carriage motion. The invented apparatus is suitable for use in virtually any servicing operation, but has proven particularly useful in the wiping and capping of printheads in an ink-jet printer and is described as such herein.

BACKGROUND ART

To properly maintain a printer, it is necessary to periodically service the printer's printhead. In an ink-jet printer, such servicing most often involves regular removal of unwanted particulate from the printhead nozzle, it being necessary to remove such particulate to avoid clogging of the nozzle's ink port. To effect service, it is conventional to equip the printer with an apparatus which prevents the buildup of particulate by periodic wiping and capping of the printer's printhead. Servicing operations of this type are generally effected using an apparatus which moves a service station into and out of operative association with the printer's printhead to effect service thereof. Conventional apparatus for use in executing these servicing operations, however, have presented various problems, including problems related to: the amount of time the printer is off-line, complexity of the design, reliability of the design, cost of manufacturing the apparatus, cross-contamination of printheads, and the carriage and maintenance of the wipers and caps during the printhead servicing operation.

Although certain improvements in apparatus which effect printhead servicing have been proposed, such improvements have generally involved solutions which are unacceptably expensive and complex. One such improvement was described in U.S. patent application Ser. No. 07/949,197 entitled "Ink-jet Printhead Capping and Wiping Method and Apparatus", which was filed on Sep. 21, 1992, and which is owned commonly herewith. Another improvement was set forth in U.S. patent Ser. No. 07/954,846 entitled "Printhead Servicing Station for Printers", which was filed on Sep. 30, 1992, and which is commonly owned herewith. The disclosures of these patent applications are incorporated herein by the present references thereto.

DISCLOSURE OF THE INVENTION

The present invention addresses the above-identified problems by providing an apparatus for use servicing a printer's printhead, such apparatus including a sled which is cam-coupled with a base so as to accommodate selected movement of the sled between a free elevation and a servicing elevation. The sled and base are coupled via camming structure which is configured to yieldably oppose movement of the sled toward the free elevation when the sled is in the servicing elevation. Mounted to the sled is a servicing member which is gradually moved into operative association with the printer's printhead upon corresponding movement of the sled into the servicing elevation. Sled movement is effected by movement of the printer's carriage, such movement producing a corresponding lateral and vertical movement of the sled from its lowermost-free elevation to another, higher servicing elevation wherein the printhead is serviced.

DETAILED DESCRIPTION AND BEST MODE FOR CARRYING OUT THE INVENTION

Figure 1:
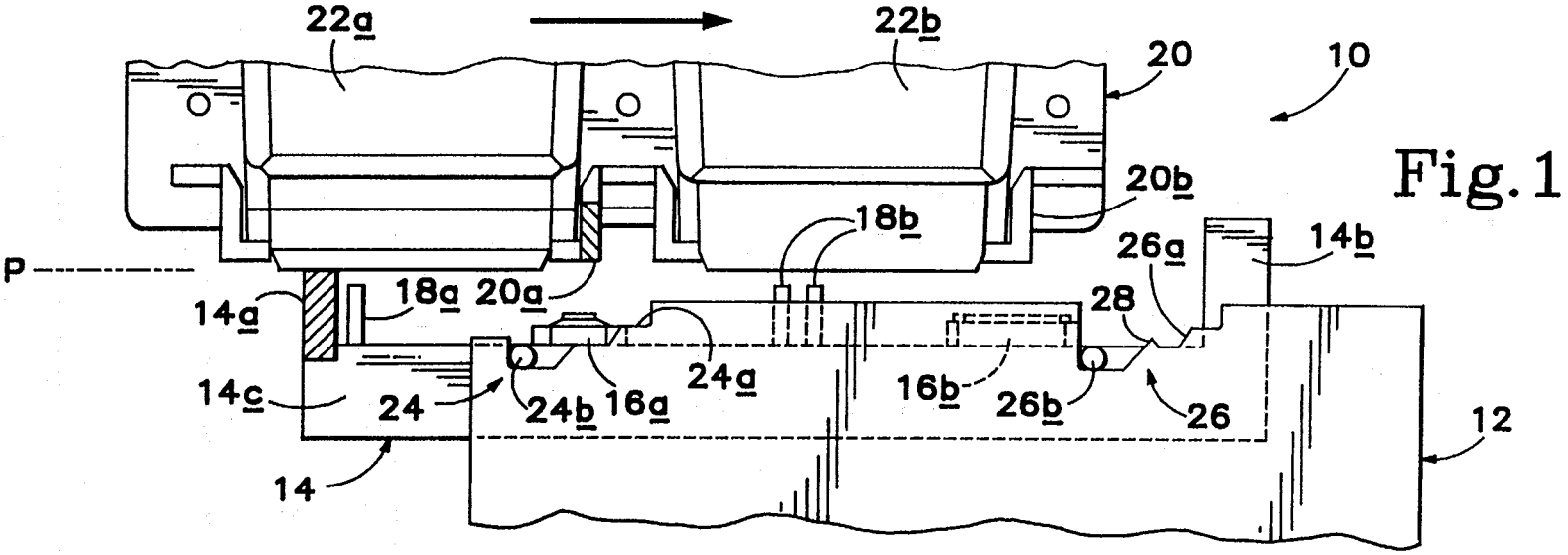
FIGS. 1 through 5 are a series of simplified front elevations of the invented printhead servicing apparatus, made in accordance with a preferred embodiment of the invention and showing various phases of its operation.

As stated above, the present invention relates generally to printers, and more particularly, to an apparatus for use in effecting controlled service of a printer's printhead. Although the invented apparatus is suited for use in the servicing of virtually any style printhead, it has demonstrated particular utility in the servicing of printheads in an ink-jet style printer. Consequently, the apparatus is described below in the context of an ink-jet style printer of somewhat conventional design.

Turning now to the drawings, it will be appreciated that a preferred embodiment of the invented servicing apparatus is shown in FIGS. 1 through 5 in front elevational view. As indicated, the apparatus forms a part of an ink-jet printer 10, such printer being shown only fragmentarily and in greatly simplified form. By these drawings, the reader is provided with a series of drawings which illustrate the printer in the vicinity of the invented servicing apparatus during various phases of its operation.

In accordance with the present invention, attention is drawn to the fact that printer 10 includes base 12, such base serving as a reference structure relative to which movement of other structure is herein described. In one embodiment, the base forms an integral part of the printer's chassis, being molded as a part thereof. Those skilled in the art, however, will recognize that the invention is not necessarily so limited, it being equally plausible to utilize separate structure which is suitably mounted on the printer's chassis.

A movable sled 14 is mounted on the base 12, the sled preferably being configured for sliding movement relative to the base so as to accommodate printhead servicing thereby. The sled includes, adjacent its opposite ends, first and second upstanding portions **14*a*, 14*b*, each providing a surface against which a force may be applied to drive the sled into various orientations relative to the printer's base. In order to effect printhead servicing, the sled mounts an array of servicing members such as caps 16*a*, 16*b* (each having a printhead-sealing lip at its upper extent), and wipers 18*a*, 18*b* (each having a wiping surface adjacent its upper terminal end). The servicing members are mounted on a generally horizontal portion of the sled 14*c*, and are arranged in linear succession so as to accommodate printhead servicing by movement of the sled in a single plane (parallel to the plane of the paper in FIGS. 1 through 5**).

As indicated in FIGS. 1 through 5, printer 10 also includes a horizontally reciprocable carriage 20 which selectively engages the sled to drive it between a free elevation (such as that shown in FIG. 1) and a servicing elevation (such as those shown in FIGS. 2 through 5). Toward this end, reciprocable carriage 20 includes first and second engagement regions **20*a*, 20*b*, each being configured to selectively engage a corresponding upstanding sled region 14*a*, 14*b*. Carriage 20, it will be appreciated, is the printer's printhead carriage, which carriage will be understood to mount plural printheads 22a, 22b, the operative bottom surfaces of which define a first substantially horizontal plane P indicated by dashed lines in FIGS. 1 through 5. By movement of the sled into the servicing elevation shown in FIGS. 2, 3 and 5, the wipers are placed in operative association with corresponding printheads. Correspondingly, by movement of the sled into the servicing elevation shown in FIG. 4**, the caps are placed in operative association with corresponding printheads. The carriage is thus capable of simultaneously moving the printheads into a servicing position and urging the sled into a corresponding servicing elevation.

Further exploring the manner in which the sled is moved into its various elevations, and focusing attention specifically on the relationship between the sled and base, it will noted that such components are cam-coupled via plural camming structures of the type indicated generally at 24 and 26 in FIGS. 1 through 5. As will be appreciated upon reading further, such cam-coupling of sled 14 with relatively fixed base 12 produces slight vertical movement of the sled in response to controlled, reciprocal, horizontal carriage movement. Reciprocal movement of carriage 20 relative to base 12, in accordance with the preferred apparatus of the invention, automatically is provided by the printer's carriage controller, a device which can be programmed cam-action-produced to move the carriage through a predetermined servicing routine. Consequently, in a service mode of operation of the printer, sled 14 undergoes programmed vertical and lateral movement which results in controlled placement of caps 16a, 16b and wipers 18a, 18h into predefined servicing positions relative to their corresponding printheads. It will be appreciated that the printer carriage's singular drive motor may thus be used to direct printer operation during both the service mode of operation described herein and the normal printing mode of operation which generally follows and precedes the service mode of operation.

The camming structures referenced in describing the relationship between the base and sled are made up of a first cam member which forms a part of the base and a second cam member which forms a part of the sled. Such cam members selectively engage one another in a complementary manner to produce cam-action-controlled vertical movement of the sled relative to the base. To establish this relationship, base 12 will be seen to include a plurality of first cam members such as cam surfaces 24a, 26a, and sled 14 may be seen to include a plurality of corresponding second cam members such as cam followers 24b, 26b. The cam surfaces are configured for cammed interface with the followers, such cam surfaces generally defining the paths along which corresponding followers are to travel. Toward this end, each cam surface has a predefined profile which includes a plurality of generally horizontal regions (ledges) separated by generally inclined regions (ramps). Although only two such followers are shown, it will be appreciated that three or more such cam followers may be provided, and preferably a total of four such followers with two on each side of the generally plano-rectangular sled 14. Correspondingly, four cam surfaces of the type described above are preferably provided on base 12 to horizontally stabilize the sled relative to the base.

In the particular device illustrated, cam surface 26a will be seen to include a first, lower horizontal region, a second, intermediate horizontal region, and a third higher horizontal region, each such region being capable of supporting corresponding sled follower 26h from below. The other cam surfaces, it will be appreciated, each include similar horizontal regions for supporting corresponding followers as described above. When the sled followers are supported by the lower horizontal regions, the sled is in its free elevation (FIG. 1), its caps and wipers being positioned so as to allow unobstructed passage of the printheads past the servicing members. When the sled followers are supported by the intermediate horizontal regions, the sled is in a first servicing elevation (FIGS. 2,3 and 5), the wipers being in printhead-interference positions (with the upper terminal ends of the wipers in appropriate coincidence with plane P) so as to wipe the printer's printhead upon selected printhead carriage movement as will be described below. Finally, when the sled followers are supported by the higher horizontal regions, the sled is in a second servicing elevation (FIG. 4), the caps being in printhead-interference positions (with the printhead-sealing lips in approximate coincidence with plane P) to cap the printer's printheads.

It will be noted that cam surface 26a includes a first inclined region which connects the lower and intermediate horizontal regions and a second inclined region which connects the intermediate and higher horizontal regions. Cam surface 26a is thus a generally continuous path along which follower 26b may slidably travel. The other cam surfaces include similar inclined regions, providing for movement of the sled to its various elevations by passage of the followers along corresponding inclined regions.

Referring now with particularity to the intermediate horizontal region of cam surface 26a, it will be noted that such intermediate region includes a lip, or detent 28, such detent being suited for capture of follower 26b to yieldably oppose relative sliding passage thereof from the first servicing elevation to the free elevation. The intermediate horizontal region of cam surface 24, it will be noted, does not include any such detent, permitting sliding passage of follower 24b thereacross were it not for opposition provided by detent 28 on cam surface 26a. Where, as is the case in the depicted embodiment, the intermediate region forms a groove which corresponds substantially to the shape of a follower so as to prevent sliding passage of the follower thereacross, the camming structure may be considered to lock the follower, and thus the sled, in place. To release the sled, the sled is pivoted only slightly about an axis defined by follower 24b so as to lift follower 26b over detent 28 allowing passage of follower 26b past the detent and onto the lower horizontal region. Such pivot is effected by engagement of upstanding sled portion 14a by carriage engagement region 20a by movement of the carriage with a position shown in FIG. 5.

Preferably, sled 14, including at least followers 24b, 26b, is molded from a polymer material having a teflon filler. In order to provide a suitably low coefficient of friction between the followers and the cam surfaces 24a, 26b of the base, the base is preferably same-polymer molded, but with a polymer material having no teflon filler. It has been found that these materials provide for smooth cam action and durability, properties desirable in sliding mechanical combinations similar to that just described. Obviously, other suitable materials may be used, but lightweight and inexpensively manufactured parts are preferred.

Figure 2:
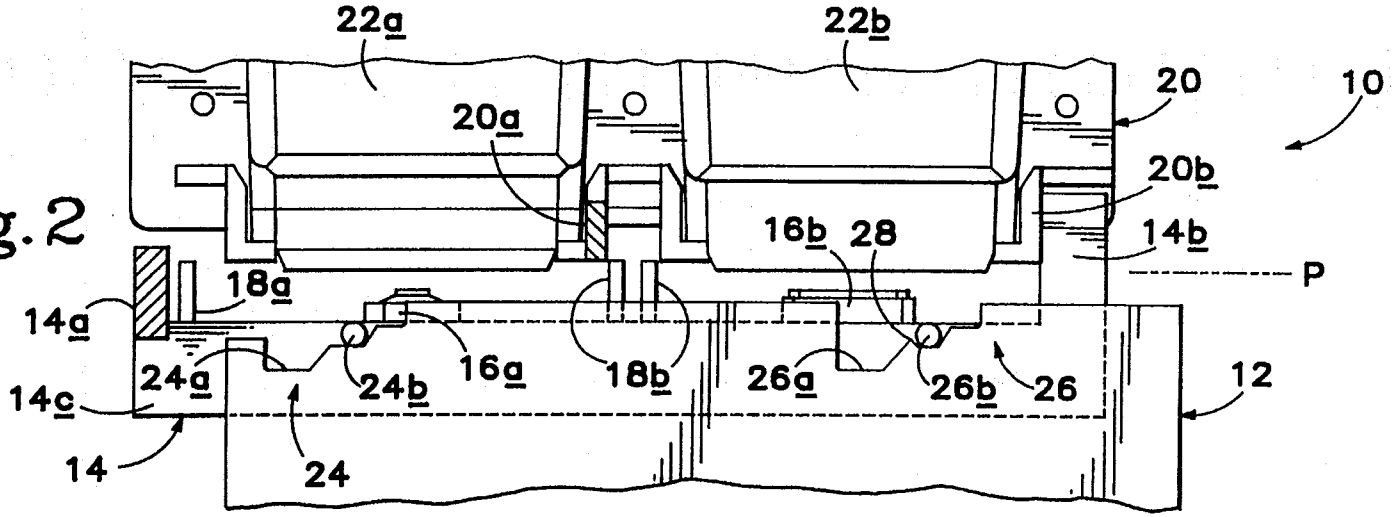

Having observed the details of the invented printhead servicing apparatus, attention is now given to the operation of the preferred embodiment of the invention, various steps of a typical servicing routine being illustrated by reference to FIGS. 1 through 5. With initial reference to FIGS. 1 and 2, it will be understood that sled 14 moves from its free elevation (FIG. 1) to a wiping elevation (FIG. 2) by movement of the printer's printhead carriage 20. As indicated by the arrow in FIG. 1, the carriage moves in a first direction, the carriage's second engagement region **20*b* eventually engaging the sled's second upstanding portion 14*b* so as to urge the sled into its first servicing elevation (wiping elevation). FIG. 2** may thus be seen to illustrate a wiping elevation in which the plane P, defined by the printheads nominally, with slight interference fit, is coplanar with a plane defined by the wiping surfaces of the wipers.

Figure 3:
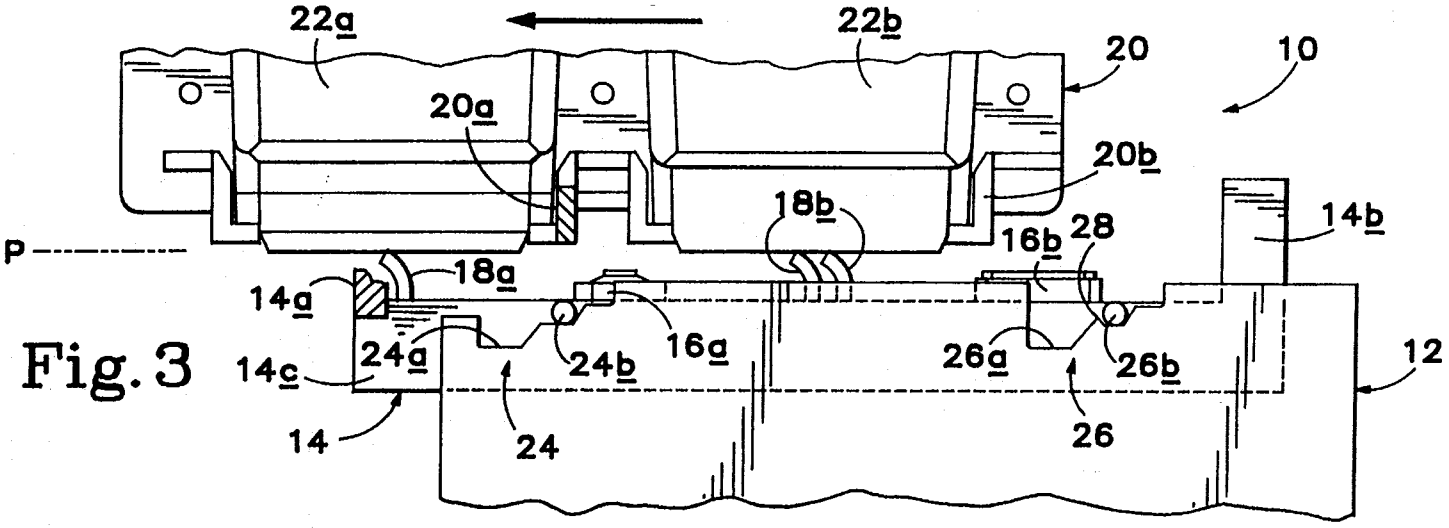

Once the sled is placed in its wiping elevation, carriage 20 is moved in the opposite direction, deflecting the wipers and wiping the printer's printheads, as shown in FIG. 3. Detent 28 maintains the position of the sled relative the base, opposing any forces due to the interference between the wipers and the printheads which would otherwise cause sled movement. The sled may then be moved back in the first direction, once again wiping the printheads (with the same wipers) without changing the position of the sled.

Figure 4:
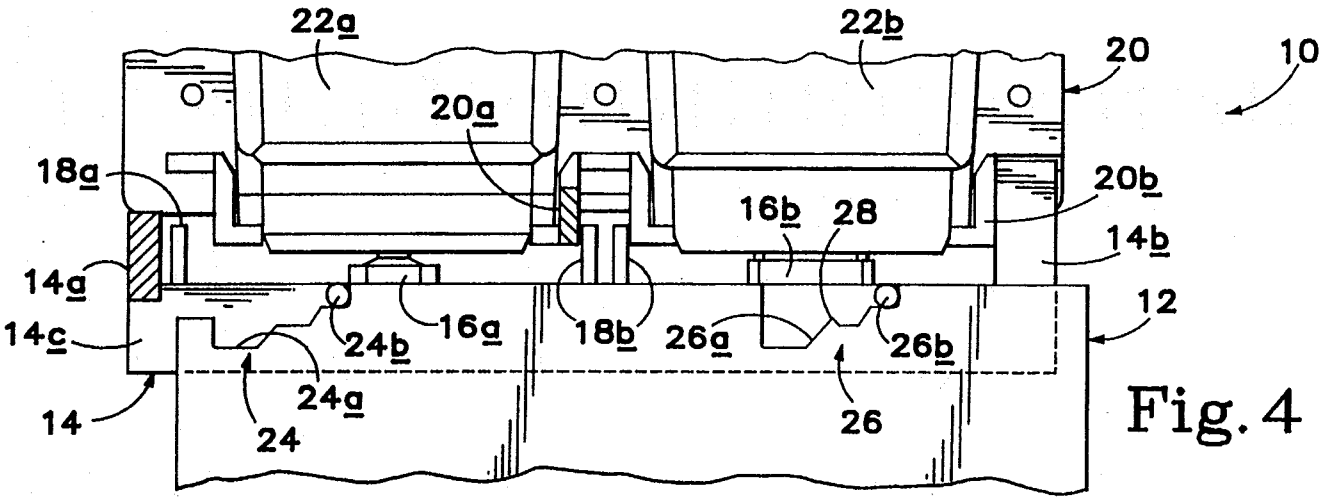

Upon continued movement, the carriage will once again engage the sled, urging it into the second servicing elevation (capping elevation) shown in FIG. 4. Thus, FIG. 4 may be seen to illustrate a capping elevation of the sled in which the plane defined by the lower surfaces of the printheads nominally, but with slight interference fit, is coplanar with the plane defined by the lips of the caps.

Figure 5:
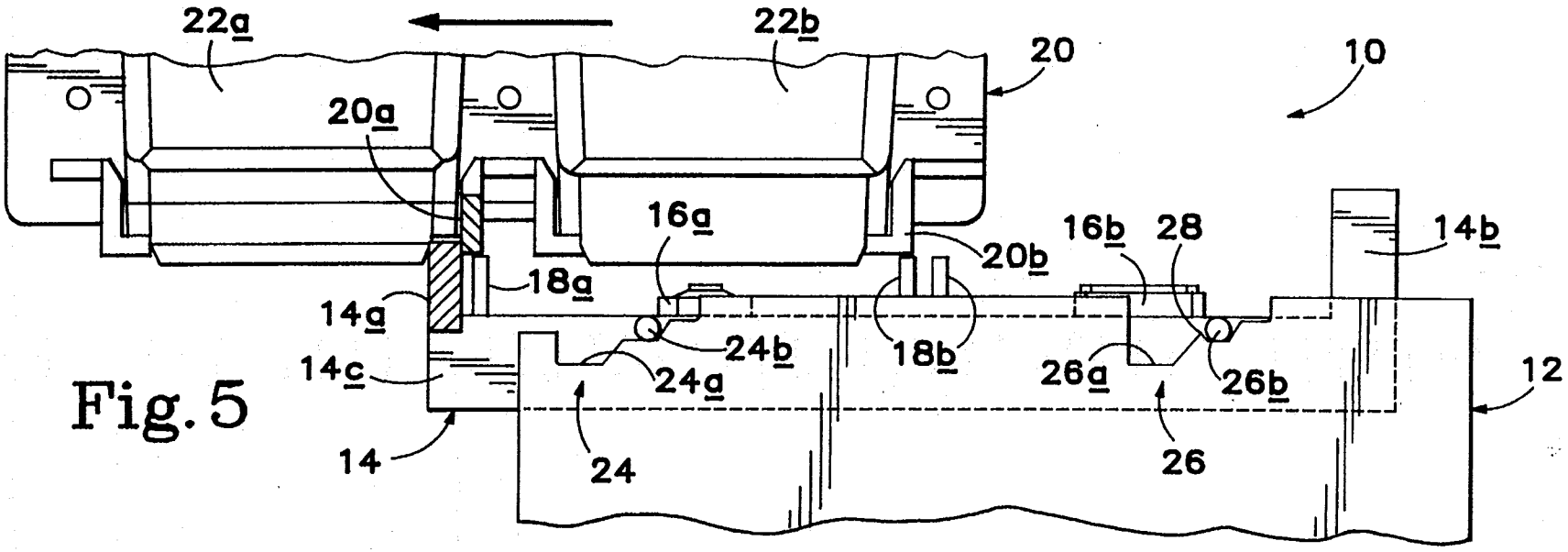

To return the sled to its free elevation, the printhead carriage is once again moved in the opposite direction as indicated by the arrow in FIG. 5, interference between the caps and the printheads serving to urge the sled back into its wiping elevation, and contact between first engagement region **20*a* and first upstanding portion 14*a* serving to pivot the sled slightly so as to allow the sled to clear detent 28 for moving of the sled into its free position. It will be appreciated by those skilled in the art that first engagement region 20*a* and first upstanding portion 14*a*** are positioned in a plane different from that occupied by the servicing members and the printheads to avoid damage to the printheads and servicing members.

While the preferred apparatus is described as involving the servicing of plural printheads, it will be appreciated that, in accordance with the apparatus of the invention, the printer may have a singular printheads and a corresponding singular cap and wiper. It will also be appreciated that the invented apparatus, although described in the context of printhead wiping and capping, is compatible with printhead spitting, simultaneously with or closely proximate in time with, wiping. Further, the invented apparatus is compatible with printhead priming.

INDUSTRIAL APPLICABILITY

It may be seen then that the invented printhead servicing apparatus enables automatic servicing of an inkjet printer's printheads, providing wiping of each printhead by a separate wiper to avoid printhead contamination. The sled is selectively held in position during printhead wiping so as to allow multi-directional wiping without inadvertently passing the sled to its free elevation. Printhead capping, which greatly extends the life of an ink-jet printer, is also performed. Few, relatively simple parts are required and provide a relatively low-cost servicing solution, while avoiding the cost of additional drive motors. This is made possible by variously positioning the sled by cam action between the sled and the base. Controlled reciprocal, horizontal movement of the printer's carriage sequences the sled through its various positions to perform the various servicing operations (repeatedly, as needed). The invented wiping and capping apparatus take the printer off-line for only a second, and automatically restore the printer from its service mode to its printing mode of operation.

While the present invention has been shown and described with reference to the foregoing operational principles and preferred embodiment, it will be apparent to those skilled in the art that other changes in form and detail may be made therein without departing from the spirit and scope of the invention as defined in the appended claims.

I claim:

1. An apparatus for servicing an inkjet printhead, comprising:

a base;

a servicing member to service the printhead; and a movable sled supporting the servicing member, with the sled coupled to the base by a camming structure for controlled movement between a free elevation and a first servicing elevation where the servicing member is positioned to service the printhead, with the camming structure having a portion configured to maintain the position of the sled relative to the base at the first servicing elevation before release to move to the free elevation, wherein said camming structure further includes a second servicing elevation, and the apparatus further includes a second servicing member supported by the sled to service the printhead at the second servicing elevation.

2. The apparatus of claim 1, wherein said servicing member comprises a wiper member, and said second servicing member comprises a capping member.

3. An apparatus for servicing an inkjet printhead, comprising:

a base;

a servicing member to service the printhead; and a movable sled supporting the servicing member, with the sled coupled to the base by a camming structure for controlled movement between a free elevation and a servicing elevation where the servicing member is positioned to service the printhead with the servicing occurring through printhead movement, with the camming structure having a portion configured to maintain the position of the sled relative to the base at the servicing elevation before release to move to the free elevation.

4. The apparatus of claim 3, wherein:

the apparatus services plural inkjet printheads of an inkjet priming mechanism;

the servicing member comprises one of a first group of servicing members, with each servicing member performing a first service to an associated printhead; and the movable sled supports the first group of servicing members in a position to service each printhead when the sled is at the servicing elevation.

5. The apparatus of claim 3 which further comprises a movable carriage which selectively engages said sled to produce cam-action-controlled movement of the sled relative to the base.

6. The apparatus of claim 3 which further comprises a horizontally reciprocable carriage which carries the printhead, with said carriage selectively engaging and driving the sled between the free elevation and the servicing elevation.

7. The apparatus of claim 3, wherein said camming structure includes a first cam member which forms a part of said base and a second cam member which forms a part of said sled.

8. The apparatus of claim 7, wherein said portion configured to maintain the sled at the servicing elevation comprises one of said first and second cam members including a detent that captures the other of said first and second cam members.

9. The apparatus of claim 7, wherein either the first or the second cam member comprises two cam surfaces, with one of the cam surfaces including said portion configured to maintain the sled at the servicing elevation before said release.

10. The apparatus of claim 7, wherein said servicing member comprises a cam surface, and said second cam member comprises a cam follower.

11. An apparatus for servicing an inkjet printhead, comprising:

a base;

a servicing member to service the printhead when at a servicing elevation; and a movable sled supporting the servicing member, with the sled coupled to the base by a camming structure for translational and pivotal movement in a single plane between a free elevation and the servicing elevation, with the camming structure having a detent portion that maintains the sled at the servicing elevation until the sled pivotally moves over said portion to move to the free elevation.

12. The apparatus of claim 11, wherein said camming structure includes a first cam member supported by the base and a second cam member supported by the sled, with either the first or the second cam member comprising two cam surfaces one of which includes said detent portion.

13. The apparatus of claim 11 wherein:

the apparatus services plural inkjet printheads of an inkjet printing mechanism;

the servicing member comprises one of a first group of servicing members, with each servicing member performing a first service to an associated printhead; and the movable sled supports the first group of servicing members in a position to service each printhead when the sled is at the servicing elevation.

14. A method of servicing an inkjet printhead, comprising the steps of:

positioning a servicing sled supporting a first service member at a free elevation to allow the printhead to reciprocate freely past the first service member;

translationally moving the sled to a first service elevation;

maintaining the sled at the first service elevation with a detent portion while servicing the printhead with the first service member;

pivotally moving the sled from the first service elevation; and translationally returning the sled to the free elevation following the pivotally moving step;

wherein said sled positioning, translationally moving, pivotally moving and translationally returning steps are performed by moving the sled through a single plane.

15. The method of claim 14 wherein:

the first service member comprises a wiper member;

the sled also supports a second service member comprising a capping member; and the method further includes the steps of:

during the maintaining step, reciprocating the printhead past the wiper member to wipe the printhead;

translationally moving the sled from the first service elevation to a second service elevation; and capping the printhead at the second service elevation.

16. An apparatus for servicing an inkjet printhead, comprising:

a servicing member to service the printhead;

a base including a cam surface having first and second lateral regions separated by an inclined region, with the second lateral region defining a detent thereon; and a movable sled supporting the servicing member, with the sled having a follower that travels along the cam surface to direct movement of the sled between a free elevation where the follower rests on the first lateral region and a servicing elevation where the follower rests on the second lateral region, with the detent located to maintain the position of the sled relative the base by opposing travel of the follower from the second to the first lateral region to the first lateral region.

17. The apparatus of claim 16 which further comprises a horizontally reciprocable carriage which carries the printhead, said carriage selectively engaging and driving said sled from said free elevation to said servicing elevation.

18. The apparatus of claim 16, wherein said servicing member is a wiper, said wiper being mounted on said sled such that movement of said sled from said free elevation to said servicing elevation brings said wiper into a printhead-interference position, said wiper thus being configured to wipe the printhead upon selected carriage movement.

19. The apparatus of claim 18, wherein said servicing elevation comprises a first servicing elevation, and the cam surface further includes a second servicing elevation, with the apparatus further including a second servicing member supported by the sled to service the printhead at the second servicing elevation.

20. An apparatus for servicing an inkjet printhead, comprising:

a base;

a first servicing member to service the printhead when at a first servicing elevation:

a movable sled supporting the first servicing member, with the sled coupled to the base by a camming structure for translational and pivotal movement in a single plane between a free elevation and the servicing elevation, with the camming structure having a portion that maintains the sled at the first servicing elevation until the sled pivotally moves over said portion to move to the free elevation, wherein said camming structure further includes a second servicing elevation; and a second servicing member supported by the sled to service the printhead at the second servicing elevation.

* * * * *